US005335516A

United States Patent [19]

Hsiang

[11] Patent Number: 5,335,516

[45] Date of Patent: Aug. 9, 1994

[54] DYEING MACHINE

[76] Inventor: Chen C. Hsiang, No. 1-2, Lane 975, Chun-Jih Road, Tao-Yuan City, Taiwan

[21] Appl. No.: 87,535

[22] Filed: Jul. 8, 1993

[51] Int. Cl.[5] ..... D06B 3/28

[52] U.S. Cl. ..... 68/4; 68/177

[58] Field of Search ..... 68/177, 178, 4

[56] References Cited

U.S. PATENT DOCUMENTS

| | | | |
|---|---|---|---|
| 3,949,580 | 4/1976 | Trullas | 68/177 |
| 3,982,411 | 9/1976 | Kreitz | 68/177 |
| 4,981,025 | 1/1991 | Brazzoli | 68/178 |

FOREIGN PATENT DOCUMENTS

| | | | |
|---|---|---|---|
| 179865 | 10/1984 | Japan | 68/177 |
| 199965 | 10/1985 | Japan | 68/177 |
| 110963 | 5/1987 | Japan | 68/177 |
| 139471 | 5/1990 | Japan | 68/177 |

*Primary Examiner*—Philip R. Coe

*Attorney, Agent, or Firm*—Morton J. Rosenberg; David I. Klein

[57] ABSTRACT

A cylindrical dyeing bath is provided having a head portion disposed above and connected to one end of the cylindrical dyeing bath, the head portion incorporating a driven roller. A three-way valve is connected to the opposing end of the cylindrical dyeing bath. A first circulating tube is disposed above the cylindrical dyeing bath, and connected between the head portion and the three-way valve. A second circulating tube is disposed under the cylindrical dyeing bath, and connected between the head portion and the three-way valve. Cloth is selectively passed through the first or second circulating tube by respective positioning of the three-way valve.

6 Claims, 8 Drawing Sheets

DYEING MACHINE

BACKGROUND OF THE INVENTION

This invention relates to a dyeing machine and, more particularly, to a dyeing machine with an improved configuration which facilitates the dyeing of a variety of textiles with different thicknesses and special fabrics. Those dyed textiles or fabrics have a smooth surface without any wrinkled lines.

In dyeing engineering, there are a variety of textiles to be dyed. As classified to thick cloth, there are textile, textile fabric, natural fabric etc; as classified to thinner cloth, there are artificial fibers, crinkled cloths etc. There are also some special cloths. As dyeing different cloth, different dyeing conditions and requirements shall be set to achieve satisfactory results.

As illustrated in FIG. 1, a conventional dyeing machine 1 includes a cylindrical dyeing bath 11; a head portion 12; a roller 13 which installed within the head portion 12; a nozzle 14; and a circulating tube 15. This conventional dyeing machine 1 features that the nozzle 14 is installed behind the head portion 12 and the circulating tube 15 is connected thereafter. As the cloth 2 is driven by the roller 13, the cloth 2 is firstly entering the circulating tube 15, then move into the cylindrical bath 11. This dyeing process will continue for several cycles to achieve satisfactory results. This conventional dyeing machine 1 is specially suitable For a thick cloth since it has a slow rotating speed. On the other hand, as the cloth to be dyed is driven by a roller 13, which is coated with a thick fabric plate, the cloth passes through will certainly generate a plurality of wrinkled lines. For an ordinary cloth, these wrinkled lines can be flattened afterwards by pressing. But those cloths with higher requirements or special cloth, are not recommended to be dyed with a conventional dyeing machine 1.

Besides, as the circulating tube 15 is disposed above the cylindrical dyeing bath 11, it can only be operated at a low speed. In light of this, it is not recommended for the thinner cloth to be dyed with a conventional dyeing machine 1 because of its poor dyeing effect. Hence, as a thinner cloth is to be dyed, a dyeing machine 1 with a lower circulating tube 15 under a cylindrical dyeing bath 11 is recommended. By this arrangement, the rotating speed can be increased to a extent for a better dyeing result.

From the above description, it is understood that a conventional dyeing machine 1 is used to dye a variety of cloth despite their quality requirement or thickness. As limited by the conventional dyeing machine, the wrinkled line become a inevitable result of a dyed cloth. Hence, the dyeing result is poor. Besides, the conventional dyeing machine costs forty thousands dollars and more, it is not economical if it is only limited to certain cloth.

SUMMARY OF THE INVENTION

It is the object of this invention to provide a improved dyeing machine, wherein the thicker or thinner cloth to be dyed can achieve a better and satisfactory result.

In order to achieve the objects set forth, an improved dyeing machine includes a cylindrical dyeing bath which has a conventional shape; a head portion is disposed above and connected by one end of said cylindrical dyeing bath and incorporated with a driven roller, a three-way valve is also connected to the other end of said cylindrical dyeing bath; a first circulating tube is disposed above said cylindrical dyeing bath, said first circulating is connected between said head portion and said three-way valve; and a second circulating tube, which is disposed under said cylindrical dyeing bath, said second circulating tube is connected between said head portion and said three-way valve.

This improved dyeing machine is further incorporated with a third circulating tube which is disposed above said first circulating tube and connected between said head portion and a two-way valve connected to one end of said first circulating tube.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of an improved dyeing machine.

In the drawings.

DESCRIPTION OF THE EMBODIMENTS

Figure 1:
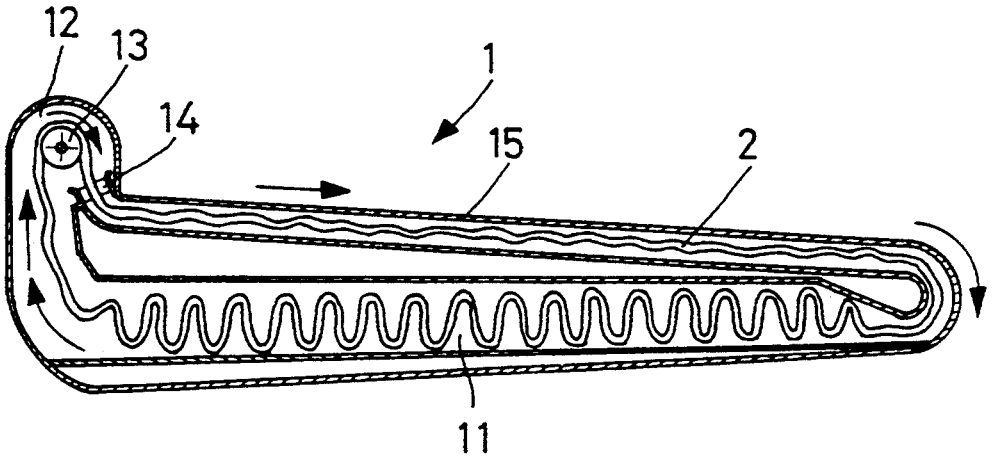
PRIOR ART FIG.1
FIG. 1 is a schematic representation of a conventional dyeing machine.
Figure 2:
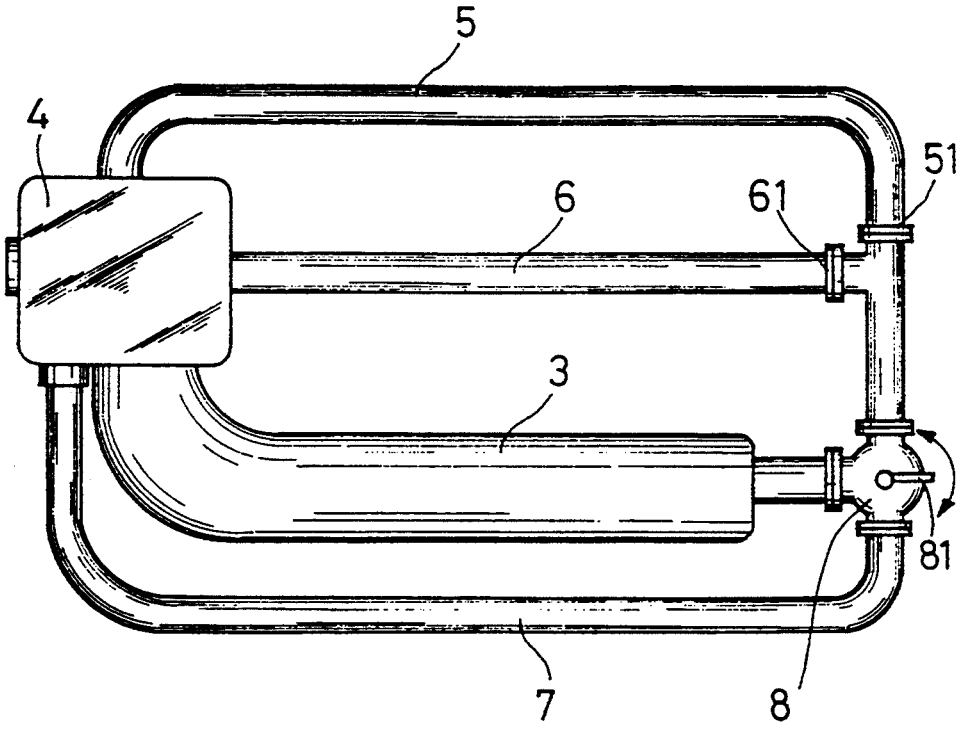
FIG. 2 is an illustration of an embodiment of a dyeing machine made according to the instant invention.

Referring to FIG. 2, the dyeing machine made according to this invention includes a cylindrical dyeing bath 3 which has a conventional shape; a head portion 4, which is disposed above and connected by one end of said cylindrical dyeing bath 3 and incorporated with a driven roller 44, a three-way valve 8 is also connected to the other end of said cylindrical dyeing bath 3. Said three-way valve is controlled by an operating lever 81. Said three-way valve 8 is further connected with a connecting tube which has a first connecting gate 61 and a second connecting gate 51. A first circulating tube 6 is disposed above said cylindrical dyeing bath 3 and is connected between said head portion 4 and said gate 61 of said connecting tube. A second circulating tube 7 is disposed under said cylindrical dyeing bath 3 and is connected between said head portion 4 and said three-way valve 8. This improved dyeing machine is further incorporated with a third circulating tube 5 which is disposed above said first circulating tube 6 and connected between said head portion 4 and said gate 51 of said connecting tube. By this arrangement and the operation of said operating lever 81 of said three-way valve 8 can proceed. Three different operating modes can be selected to apply different application.

The following are the route of those three operating modes, (3) head portion 4, third circulating tube 5, three-way valve 8, cylindrical dyeing bath 3 and head portion 4. This third operating mode is suitable for special cloth. (1), head portion 4, first circulating tube 6, three-way valve 8, cylindrical dyeing bath 3 and head portion 4. This first operating mode is suitable for a thick cloth. And (2), head portion 4, cylindrical dyeing bath 3, three-way valve 8, second circulating tube 7 and head portion 4. This second operating mode is special for thinner cloth.

Figure 3:
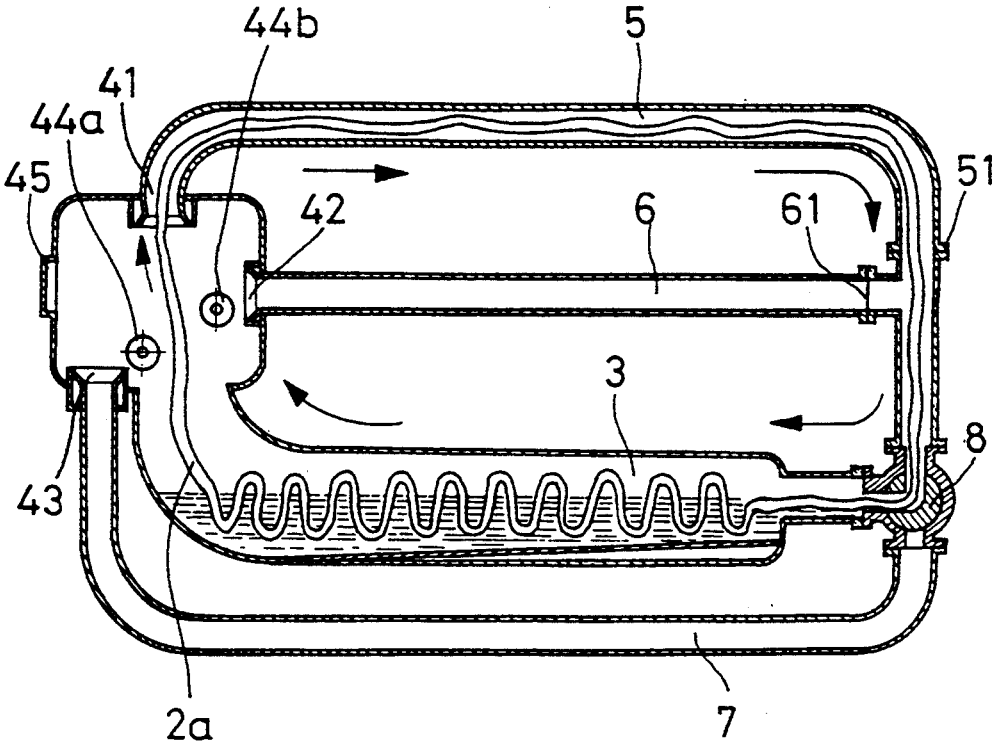
FIG. 3 is an illustration showing a third operating mode of a dyeing machine made according to the instant invention.

Referring to FIG. 3, a third operating mode of a dyeing machine made according to this invention. A third nozzle 41 disposed at the top of said head portion 4 is connected with said third circulating tube 5; a first nozzle 42 disposed side of said head portion 4 is connected with said first circulating tube 6; and a second nozzle 43 disposed at the bottom of said head portion 4 is connected with said second circulating tube 7. Said head portion also includes a roller 44 and a suitable position.

A special cloth 2*a* enters the dyeing machine via gate 45. Said three way valve 8 is switched to facilitate a communication between said third circulating tube 5 and said cylindrical dyeing bath 3, while said gate 61 is closed to block the first circulating tube 6. By this arrangement, the special cloth 2*a* is circulated via a route defined by the third nozzle 41 of said head portion 4, third circulating tube 5, three-way valve 8, cylindrical dyeing bath 3 and head portion 4. In this dyeing process, the special cloth 2*a* is driven by a thrust generated by said third nozzle 41, not by the roller 44. In light of this feature, no folded lines are generated in this dyeing process. The dyeing result is satisfactory.

Figure 4:
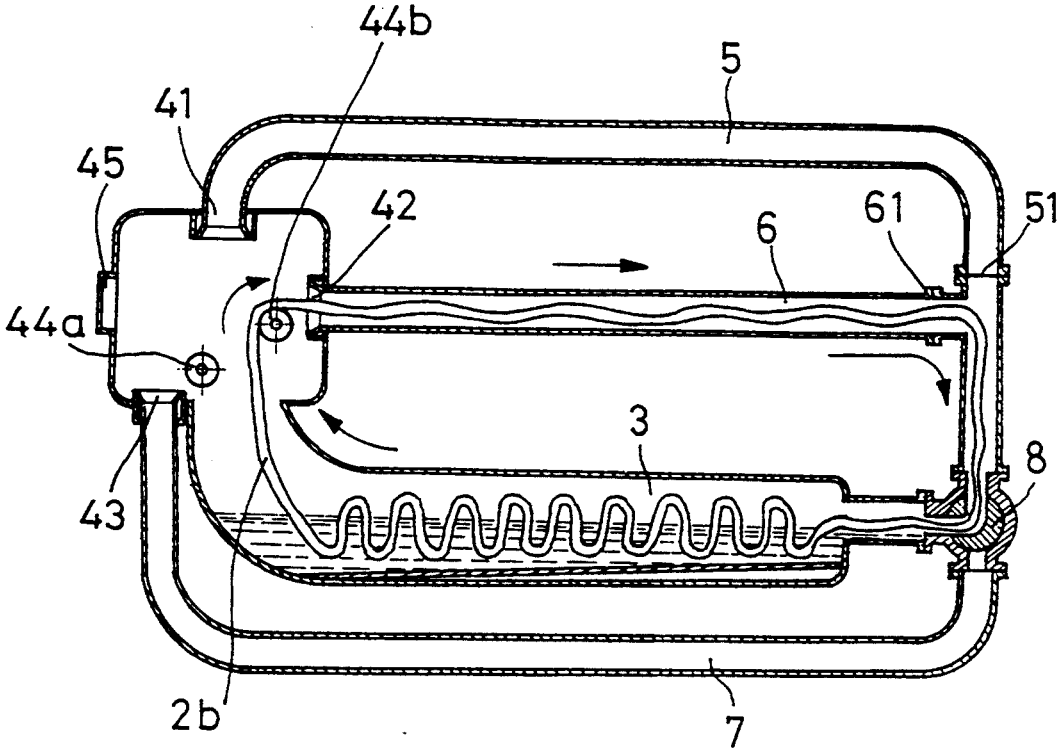
FIG. 4 is an illustration showing a first operating mode of a dyeing machine made according to the instant invention.

Referring to FIG. 4, a first operating mode defined by roller 44 and nozzle 42 of said head portion 4, first circulating tube 6, three-way valve 8, cylindrical dyeing bath 3 and head portion 4. In this operating mode, said gate 51 is closed and said gate 61 is opened, and said three-way valve 8 is remained same of the third operating mode. In this dyeing process, a thick cloth 2*b* is driven by said roller 44. As the rotating speed is low, there is a satisfactory result in the dyed thick cloth 2*b*.

Figure 5:
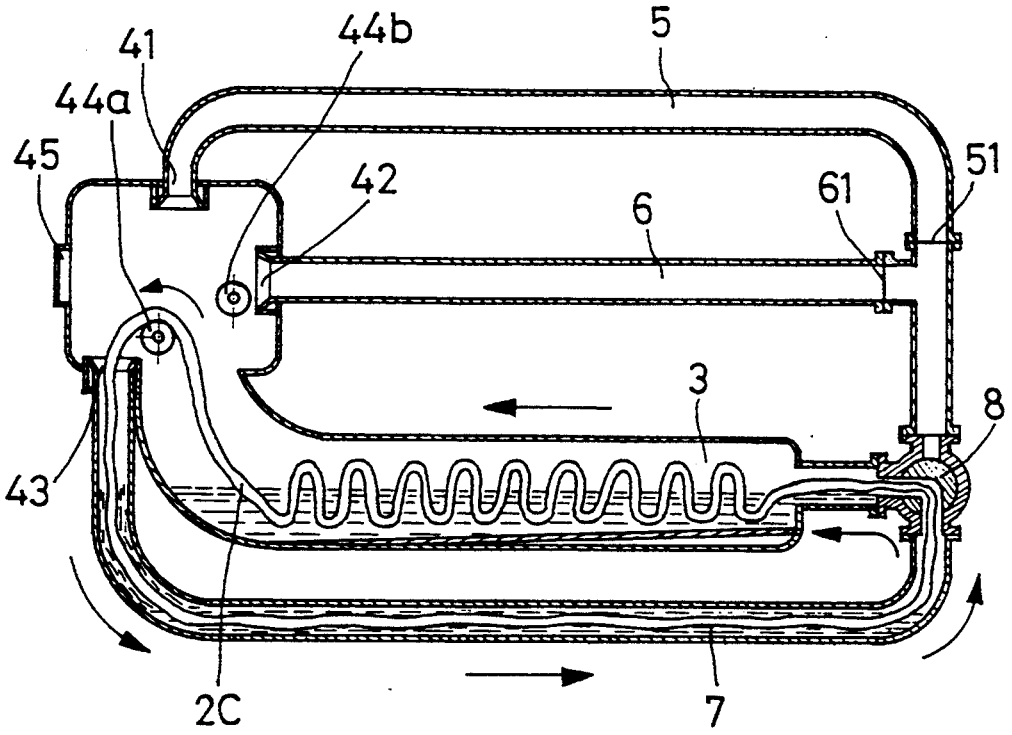
FIG. 5 is an illustration showing a second operating mode of a dyeing machine made according to the instant invention.

Referring to FIG. 5, a second operating mode for thinner cloth 2*c* defined by roller 44 and nozzle 43 of head portion 4, cylindrical dyeing bath 3, three-way valve 8, second circulating tube 7 and head portion 4. In this dyeing process, said three-way valve 8 is selected to close said first circulating tube 6 and said second circulating tube 7. Besides, the thinner cloth 2*c* driven by said roller 44 in a anti-clockwise direction. As the rotating speed is fast, there is also a satisfactory result in the dyed thinner cloth 2*c*.

By the theory of hydrodynamics and an experiment carried out according to the dyeing machine made according to this instant invention, the horizonal circulating tube 6 incorporated with a nozzle is suitable for a low dyeing speed. As driven by the thrust of said nozzle 41, 43, the vertical third circulating tube 5 incorporated with a nozzle 41 and third circulating tube 7 is suitable for a fast circulating speed. Hence a satisfactory dyeing result on a special cloth 2*a* and a thinner cloth 2*c* can be easily achieved. As three operating modes can be integrated in a single machine, a variety of cloth can be easily dyed by the dyeing machine made according to this invention. No doubt, the dyeing effect is highly appreciated.

Figure 6:
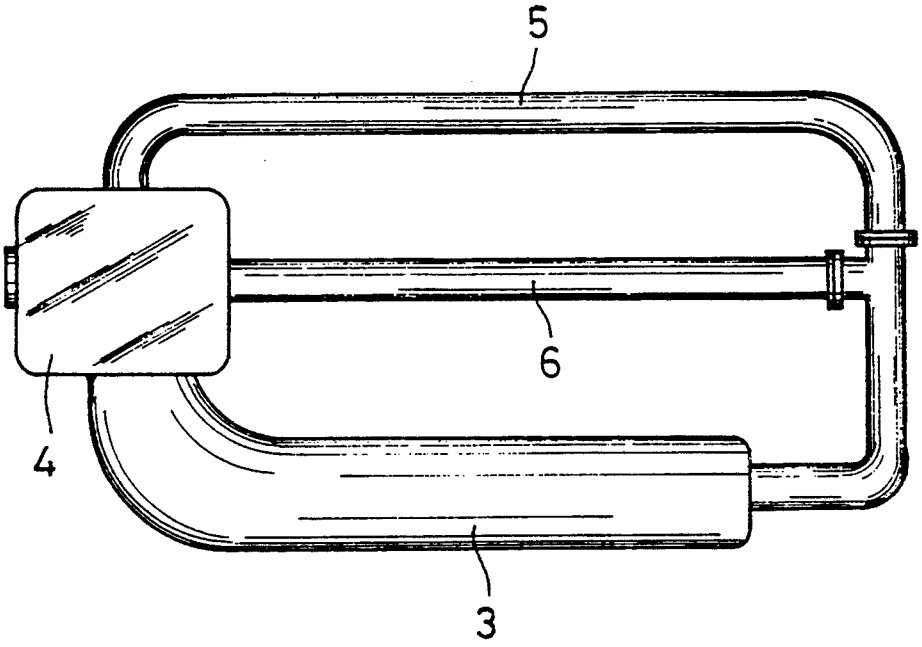
FIG. 6 is an illustration of a second feasible embodiment of a dyeing machine made according to the instant invention.

FIG. 6 shows another embodiment of a dyeing machine made according to this instant invention wherein the dyeing machine is constructed by a cylindrical dyeing bath 3 and a third circulating tube 5 and a first circulating tube 5 interconnected by a head portion 4 and a three way valve 8. This arrangement is suitable for thick cloth.

Figure 7:
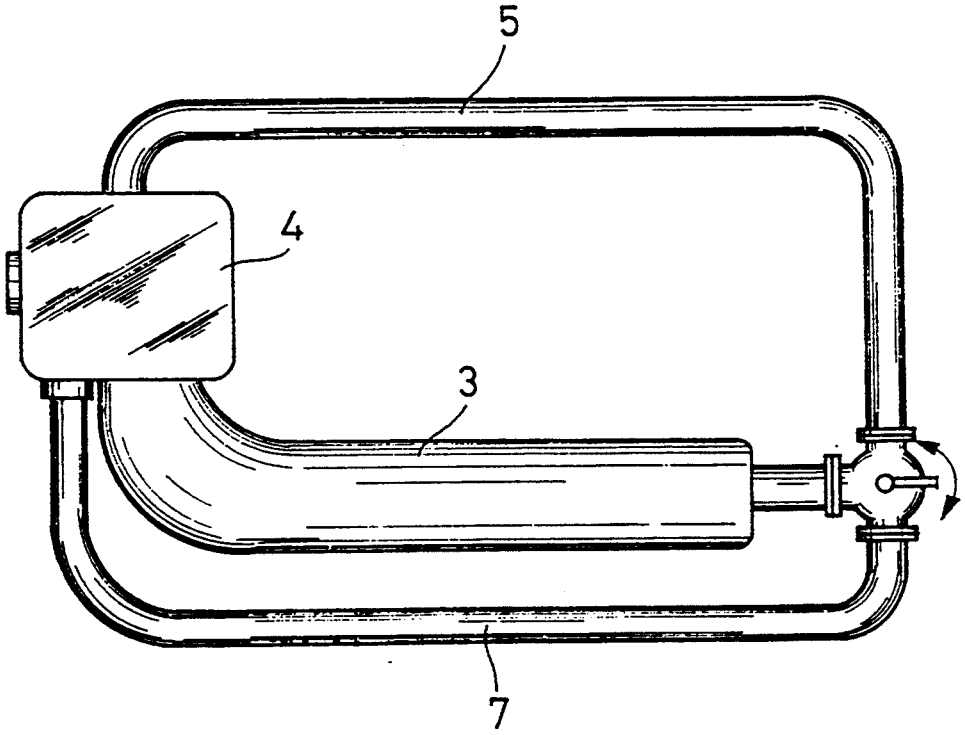
FIG. 7 is an illustration of a third embodiment of a dyeing machine made according to the instant invention.

FIG. 7 shows another embodiment of a dyeing machine made according to this instant invention wherein the dyeing machine is constructed by a cylindrical dyeing bath 3 and a third circulating tube 5 and a second circulating tube 7 interconnected by a head portion 4 and a three way valve 8. This arrangement is suitable for special cloth.

Figure 8:
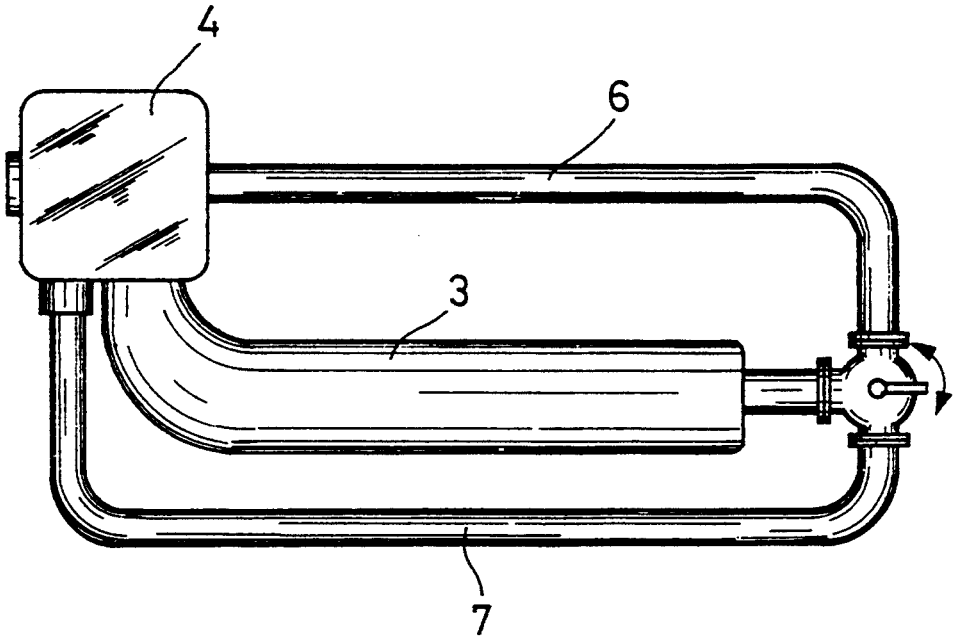
FIG. 8 is an illustration of a fourth embodiment of a dyeing machine made according to the instant invention.

FIG. 8 is still another embodiment of this instant invention wherein the dyeing machine is constructed by a cylindrical dyeing bath 3 and a first circulating tube 6 and a second circulating tube 7 interconnected by a head portion 4 and a three way valve 8. This arrangement is suitable for thinner cloth.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. An improved dyeing machine, comprising:

a cylindrical dyeing bath extending longitudinally from a first end to a second end for passage of cloth therethrough, said first end being disposed at a higher elevation than said second end;

a head portion coupled to said first end of said cylindrical dyeing bath, said head portion having a driven roller disposed therein;

a first conduit extending between said head portion and said second end of said cylindrical dyeing bath; said first conduit being disposed above said cylindrical dyeing bath;

a second conduit extending between said head portion and said second end of said cylindrical dyeing bath, said second conduit being disposed below said cylindrical dyeing bath; and, valve means interposed between said second end of said cylindrical dyeing bath and each of said first and second conduits to provide selective communication between said cylindrical dyeing bath and either of said first conduit or said second conduit for passing cloth from one of said first or second ends of said cylindrical dyeing bath through a selected one of said first or second conduits to the other of said first or second ends of said cylindrical dyeing bath.

2. A dyeing machine as recited in claim 1, wherein said head portion further includes a first nozzle which is interconnected with said first conduit.

3. A dyeing machine as recited in claim 2, wherein said head portion further includes a second nozzle which is interconnected with said second conduit.

4. A dyeing machine as recited in claim 1, wherein said dyeing machine further comprises a third conduit extending between said head portion and said valve means for selective passage of cloth therethrough.

5. A dyeing machine as recited in claim 4, wherein said head portion further includes a nozzle interconnected with said third conduit.

6. A dyeing machine as recited in claim 1, wherein said valve means includes an operating lever to select different dyeing modes.

* * * * *